US010035166B2

(12) United States Patent
Aeby et al.

(10) Patent No.: US 10,035,166 B2
(45) Date of Patent: Jul. 31, 2018

(54) COATING UNIT FOR APPLYING A COATING SUBSTANCE IN A MACHINE FOR PRINTING FLAT MEDIA

(71) Applicant: BOBST MEX SA, Mex (CH)

(72) Inventors: Steve Aeby, Bettens (CH); Pascal Baudin, Ecublens (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 15/324,318

(22) PCT Filed: Jul. 15, 2015

(86) PCT No.: PCT/EP2015/025048
§ 371 (c)(1),
(2) Date: Jan. 6, 2017

(87) PCT Pub. No.: WO2016/008595
PCT Pub. Date: Jan. 21, 2016

(65) Prior Publication Data

US 2017/0209895 A1 Jul. 27, 2017

(30) Foreign Application Priority Data

Jul. 18, 2014 (EP) ..... 14002500

(51) Int. Cl.
*B05C 1/08* (2006.01)
*B41J 11/00* (2006.01)
(Continued)

(52) U.S. Cl.
CPC ..... *B05C 1/0834* (2013.01); *B05C 9/10* (2013.01); *B05C 9/12* (2013.01); *B41J 2/01* (2013.01); *B41J 11/0015* (2013.01)

(58) Field of Classification Search
CPC . B05C 1/0834; B05C 9/10; B05C 9/12; B41J 11/0015; B41J 2/01; B41F 23/00; G03F 7/16
(Continued)

(56) References Cited

U.S. PATENT DOCUMENTS 2,798,845 A * 7/1957 De La Breteque ..... C01F 7/02 204/221
2006/0070570 A1* 4/2006 Walther ..... B41F 31/26 118/258
(Continued)

FOREIGN PATENT DOCUMENTS

DE 10 2004 005576 A1 9/2004
DE 10 2005 021186 A1 11/2005
(Continued)

OTHER PUBLICATIONS

English Translation of DE 102008001003 published Feb. 26, 2009 (MAnroland AG); pages unnumbered.*
(Continued)

*Primary Examiner* — Laura E Edwards
(74) *Attorney, Agent, or Firm* — Ostrolenk Faber LLP

(57) ABSTRACT

A surface application unit for applying a surface application substance to all or a portion of a surface of a planar substrate in a machine for printing planar substrates. The unit includes an applicator roller (11) which is rotated (T) and can be positioned against all or a portion of the surface of the substrate in order to apply the substance thereto; an anilox roller (13) which is rotated (S) and positioned against the applicator roller (11) and which covers the applicator roller (11) with the substance; and a supply system (14) which supplies the anilox roller (13) with the substance and which is provided with a substance tank, a pump, a device for circulating the substance, and a device (16) which is held against the anilox roller (13) in order to supply the substance
(Continued)

to the roller. A recovery system (18) mounted downstream of the applicator roller (11) can be positioned against the applicator roller (11) to recover excess substance on the roller (11).

14 Claims, 3 Drawing Sheets

(51) Int. Cl.
*B05C 9/10* (2006.01)
*B05C 9/12* (2006.01)
*B41J 2/01* (2006.01)

(58) Field of Classification Search
USPC ..... 118/46, 73; 347/1, 101; 101/416.1, 417, 101/419, 423, 424.2
See application file for complete search history.

(56) References Cited

U.S. PATENT DOCUMENTS

2007/0212113 A1 9/2007 Berg et al.
2011/0067627 A1* 3/2011 Fukui ..... B41J 11/0015 118/244
2014/0020625 A1 1/2014 Masuo et al.

FOREIGN PATENT DOCUMENTS

DE 10 2008 001003 B3 2/2009
DE 10 2011 005546 A1 9/2012
WO Wo2007/068415 * 6/2007
WO WO 2013/160288 A1 10/2013

OTHER PUBLICATIONS

English Translation of DE 102004005576 published Sep. 9, 2004 (Heidelberger Druckmasch AG)m; pages unnumbered.*

English Transalation of DE 102011005546 published Sep. 20, 2012 (Manroland Sheetfed GMBH); pages unnumbered.*

International Search Report dated Aug. 17, 2015 issued in corresponding International patent application No. PCT/EP2015/025048.

* cited by examiner

COATING UNIT FOR APPLYING A COATING SUBSTANCE IN A MACHINE FOR PRINTING FLAT MEDIA

CROSS-REFERENCE TO RELATED APPLICATIONS

The present application is a 35 U.S.C. §§ 371 national phase conversion of PCT/EP2015/025048, filed Jul. 15, 2015, which claims priority of European Patent Application No. 14002500.8, filed Jul. 18, 2014, the contents of which are incorporated by reference herein. The PCT International Application was published in the French language.

TECHNICAL FIELD

The present invention relates to a coating unit for applying a coating substance to a flat medium. The invention also relates to a machine for printing flat media which is equipped with a unit for applying a coating to the flat media.

TECHNICAL BACKGROUND

A printing machine is used in the packaging industry for printing flat media such as sheets or a continuous web of paper or cardboard. The machine comprises several stations in succession. A first station situated furthest upstream is an infeed station which inputs the medium in succession. The infeed station supplies several printing stations in the form of one or more printing units placed one after the other. Each printing unit prints a specific color using an ink which has an equivalent coloration. A delivery station which collects the medium which has been printed with an image is provided at the end of the machine.

For printing sheets of cardboard, more particularly corrugated cardboard, the technology used most frequently is flexography using a flexo unit. Digital printing is also developing more and more, using print units equipped with digital print heads, for example of the inkjet-type. Digital printing technology enables the packaging manufacturer to change jobs very quickly in order to print new sheets from a computer file representing the packaging.

The printing machines comprise one or more printing units depending on the number of colors desired. The medium being printed is moved longitudinally from upstream to downstream from the infeed station, to the printing units and as far as the delivery station. In order to obtain a final high-quality image on the printed medium, it is in particular necessary that all the patterns of different colors be superposed exactly. It is also necessary that the printed dots not be deformed.

The packaging is selected mainly according to the criterion of quality level chosen depending on the product which is to be packaged. The medium is currently still quality-controlled visually after printing. The operator looks for all types of faults, closely observing the printed medium, and rejects the medium or media which is or are non-compliant.

The print quality obtained depends not only on the quality of the printing machines, the quality of the inks used, but also the quality of the media input when they enter the machine. Indeed, in the case of cardboard and for the same medium, the surface can have irregularities resulting in different ink absorption properties depending on the nature of the cellulose fibers which make up the medium.

It follows that the printed image applied will have places where there is no ink and other places where there is too much ink, so that the color or colors will vary in intensity, and there will be other faults. When the drop of ink reaches the surface of the medium, it will not spread out uniformly. The image obtained is distorted by a multitude of printed dots, having a much greater surface area than that expected and visible to the naked eye, alternating with dots which appear to be printed correctly. Furthermore, the pigments of the ink are absorbed by the cardboard, resulting in less dense pigmentation density and causing a dull image to be obtained.

SUMMARY OF THE INVENTION

A main object of the present invention is to improve the print quality of a machine for printing flat media which is equipped with at least one printing unit.

Another object is to provide a printing machine equipped with a unit which makes it possible to coat all or part of the surface of the flat media.

A further object is to overcome the above-mentioned technical problems of prior art machines.

Yet another object is to succeed in inserting a coating unit in a machine for printing flat media.

According to an aspect of the invention, a coating unit applies a coating substance over the whole surface or part of the surface of a flat medium in a machine for printing flat media. The coating unit comprises:

an applicator roller, which is driven in rotation, and is capable of being positioned against all or part of the surface of the medium in order to apply the coating substance to it;

an anilox roller, which is driven in rotation, is positioned against the applicator roller, and covers the applicator roller with the coating substance; and a supply system which supplies the anilox roller with the coating substance, and is equipped with a coating substance tank, a coating substance pump, a device for circulating the coating substance, and a device which is applied against the anilox roller in order to supply the anilox roller with coating substance.

The coating unit further comprises a recovery system, which is mounted downstream with respect to the applicator roller and is capable of being positioned against the applicator roller, so as to recover excess coating substance on the applicator roller.

A flat medium is defined, in a non-limiting example, as being made from a material in the form of a sheet, a board, or a continuous strip, such as paper, flat cardboard, corrugated cardboard, laminated corrugated cardboard, flexible plastic, for example polyethylene (PE), polyethylene tetraphthalate (PET), bi-oriented polypropylene (BOPP), other polymers, or still other materials. The flat medium is defined, in a non-limiting example, as being a sheet intended to form a blank and then a packaging box.

In other words, by providing a coating unit mounted directly in the printing machine, the print quality obtained will be improved by depositing a coating substance and recovering the same substance in order to prevent waste. The print quality will no longer be dependent solely on the original medium. Because the medium is coated, the pigments remain on the surface, thus preventing mottling phenomena.

According to yet another aspect of the invention, a machine for printing flat media, equipped with at least one printing unit, comprises at least one coating unit, having one or more of the technical features described above.

BRIEF DESCRIPTION OF THE DRAWINGS

The invention will be readily understood and its various advantages and different features will become apparent from the following description of the non-limiting exemplary embodiment made with reference to the attached schematic drawings, in which.

DETAILED DESCRIPTION OF PREFERRED EMBODIMENTS

Figure 1:
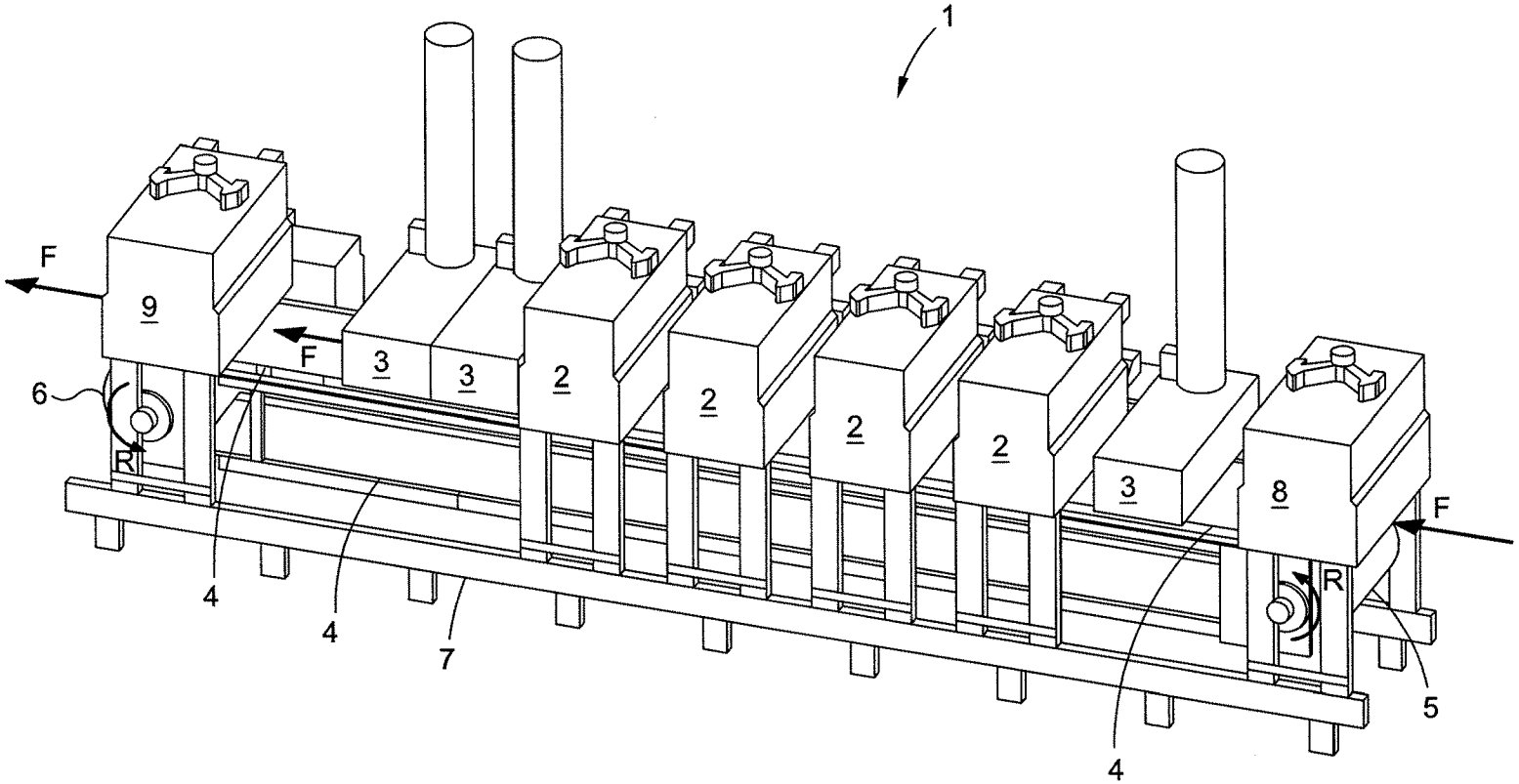
FIG. 1 shows a perspective view of a printing machine comprising two coating units according to the invention.
Figure 2:
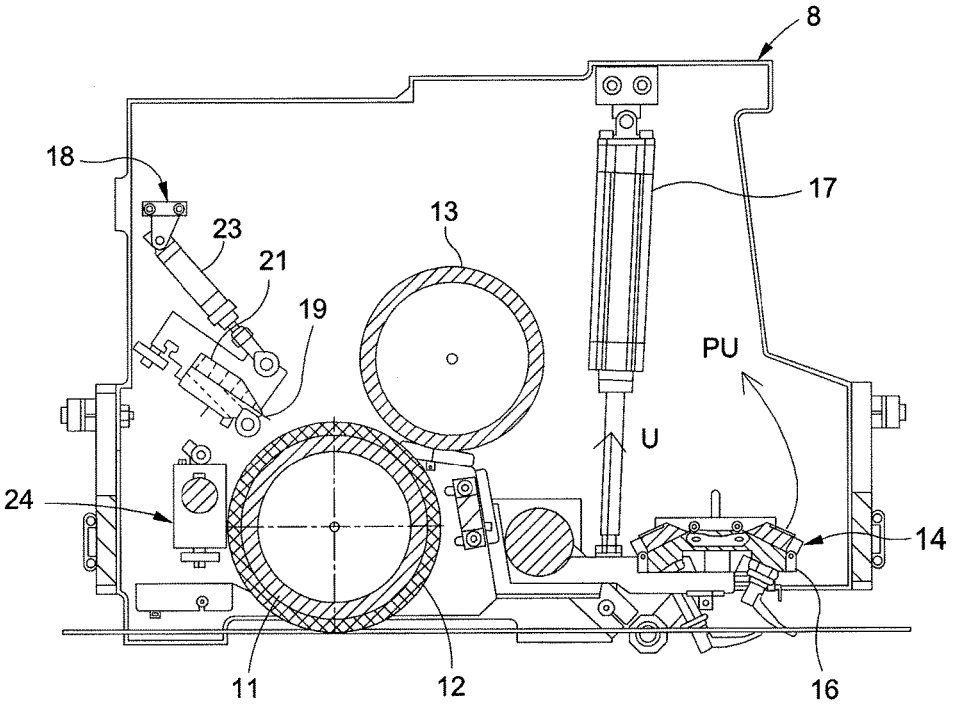
FIGS. 2 to 5 each show a side view of a coating unit according to the invention, in a non-operational position, a production position, a position between two production jobs, and a washing position, respectively.
Figure 3:
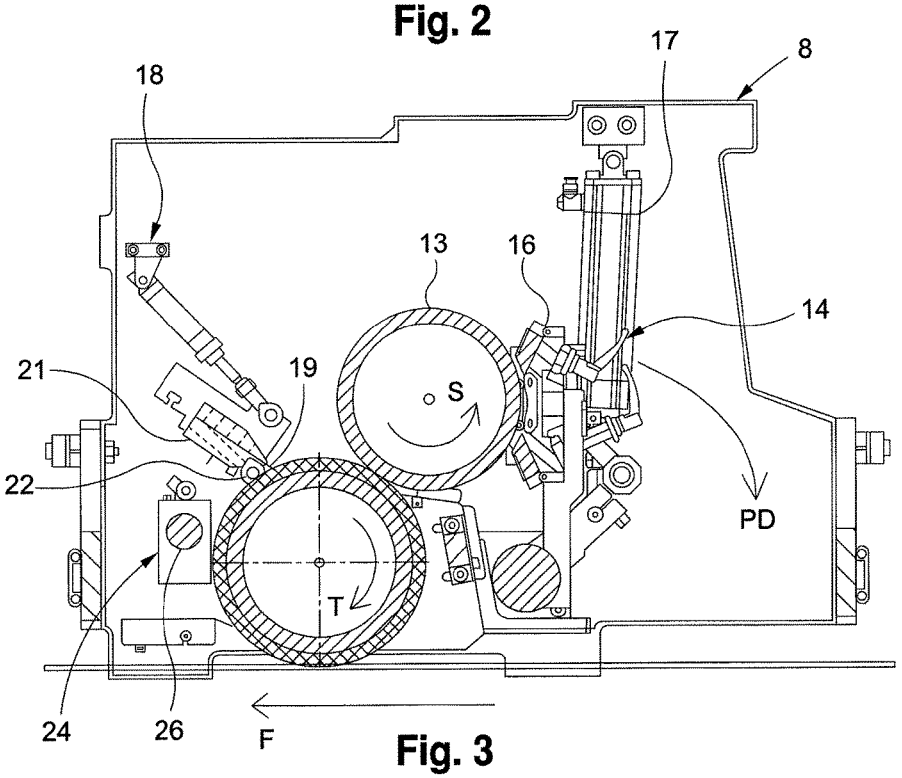
Figure 4:
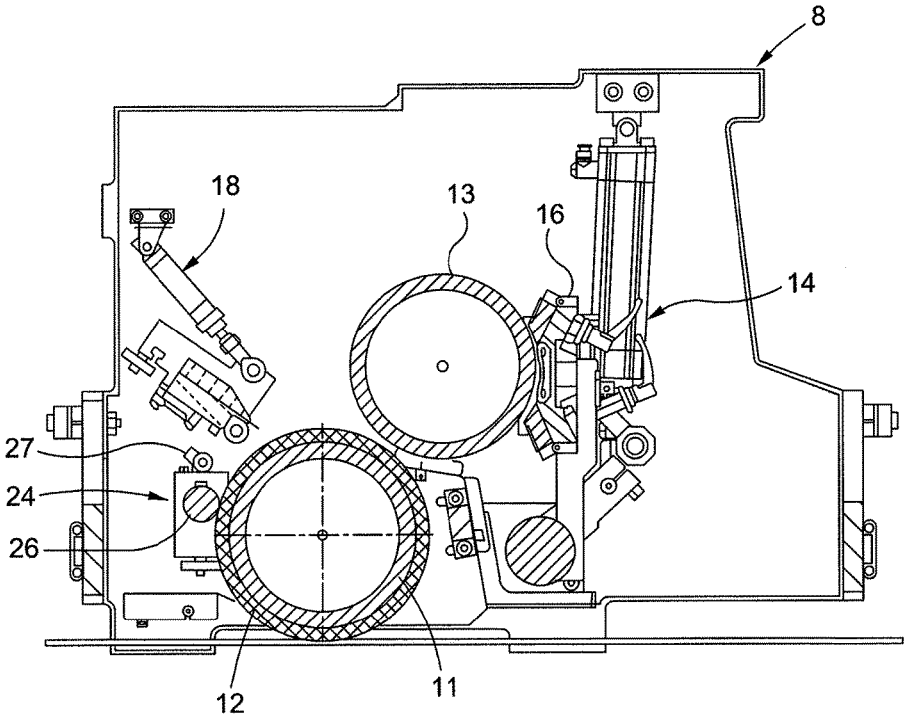
Figure 5:
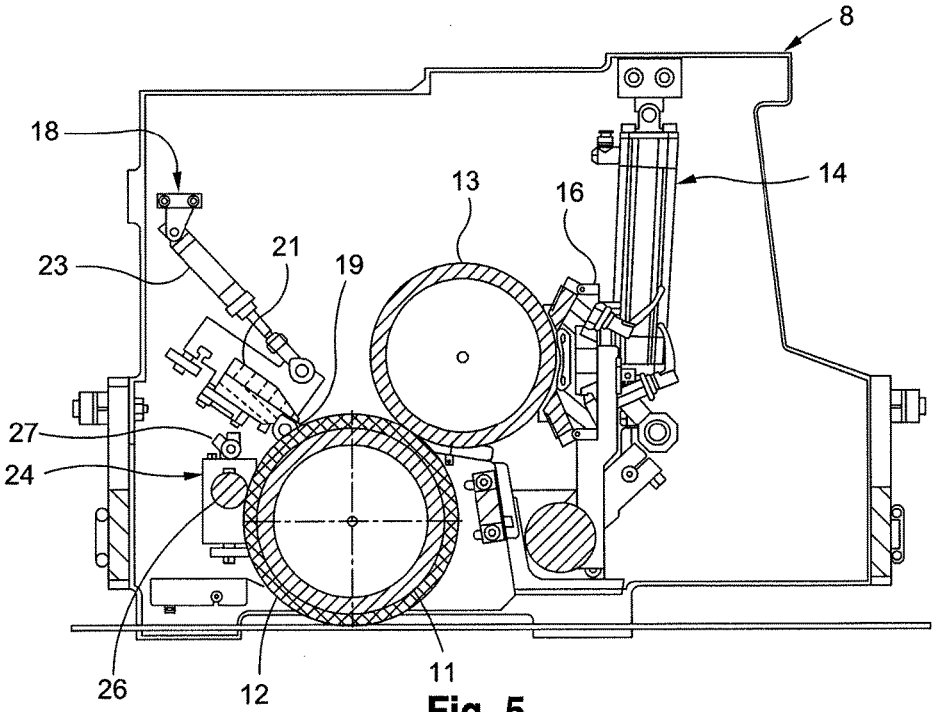

As illustrated in FIG. 1, a printing machine 1 is used for printing media in the form of plate-like elements, for example sheets of corrugated cardboard. In the main exemplary embodiment, the machine 1 is a digital printing machine which includes, for example, some constituent parts described in U.S. Pat. No. 6,471,430. The machine 1 comprises in particular a set of four printing units 2 arranged in a line, one after the other. Each printing unit 2 is equipped with at least one digital printing unit, for example a contactless print head, for example an inkjet print head. Their respective black, cyan, magenta and yellow inks are printed onto the sheets.

The sheets are input (arrows F in FIG. 1) by an infeed station (not shown), which is mounted upstream from the printing machine 1. The sheets are then gripped, are conveyed, circulate longitudinally F, and are output F after printing at a delivery station (not shown), mounted downstream from the printing machine 1. Two ink dryers 3, with steam discharge tubes, are placed downstream from the printing units 2.

The longitudinal direction is defined with reference to the trajectory of the sheets within the printing machine 1, along its central longitudinal axis. The upstream and downstream directions are defined with reference to the direction of movement in the trajectory of the sheets, in the longitudinal direction of the overall printing machine 1.

The sheets which are to be printed are conveyed from upstream to downstream by an endless metal belt 4 which is mounted between a first upstream transverse roller 5 and a second downstream transverse roller 6 shown toward the ends of the machine. At least one of the two transverse rollers 5 and 6 is driven in rotation (arrow R in FIG. 1) by means of a motor, which drives the belt 4. The rollers 5 and 6 and the belt 4 are mounted on a frame 7. The sheets remain applied flat to the belt 4 throughout the upper run or upper part of the travel of the belt and the sheets pass under the printing units 2 and then through the drying modules 3. By virtue of known suction boxes, also called vacuum boxes, the sheets are held at the belt.

The printing machine 1 comprises at least one coating unit 8 and 9 for applying a coating substance over all or part of the surface of the flat media.

In order to promote the adhesion and stability of the inks which will be deposited by printing on the cardboard sheets which are to be printed, the printing machine 1 preferably comprises an upstream coating unit 8. The upstream coating unit 8 is arranged upstream from the first printing unit 2, and just after the feed station. The upstream coating unit 8 is placed at a right angle to the upstream roller 5.

The upstream coating unit 8 applies a coating, in this case over the whole surface of the blank sheets of each print run. In this way, the surface is prepared with a pre-coating which then receives the image which is to be printed. The coating substance is an aqueous substance comprising water-soluble polymers. In order to dry the coating, a dryer 3 can be inserted between the upstream coating unit 8 and the first printing unit 2.

In order to promote the stability and protection of the inks which are deposited by printing on the cardboard sheets which have been printed, the printing machine 1 preferably comprises a downstream coating unit 9. The downstream coating unit 9 is arranged downstream from the last printing unit 2, downstream from the dryers 3 and just before the delivery station. The downstream coating unit 9 is placed at a right angle to the downstream roller 6.

The downstream coating unit 9 applies a coating, in this case over the whole surface of the now printed sheets and thus over the printed image. The printed surface is covered with a post-coating to protect the image which has just been printed and dried.

As shown in FIGS. 2 to 5, the upstream coating unit 8 and the downstream coating unit 9 each comprise an applicator roller 11. The applicator roller 11 is positioned transversely, i.e. perpendicularly, to the belt 4. The applicator roller 11 is driven in rotation (arrow T in FIG. 3) during the production phase. The applicator roller 11 is covered with a homogeneous layer of a porous material having elastic and absorbent properties, for example a flexible rubber 12.

The applicator roller 11 is capable of being positioned against all or part of the surface of the sheet in order to apply the coating substance, either the pre-coating or the post-coating, to it. The sheets circulate in the gap left between the applicator roller 11 and the belt 4. The pre-coating or post-coating substance, will thus be deposited on the sheets of corrugated cardboard on the corrugations and in the furrows between corrugations. The corrugated cardboard of the sheet should not be crushed by the flexible rubber 12 of the applicator roller 11.

The upstream coating unit 8 and the downstream coating unit 9 each comprise an anilox roller 13. The anilox roller 13 is driven in rotation (arrow S in FIG. 3) during the production phase. The anilox roller 13 is positioned parallel to the applicator roller 11. The anilox roller 13 is mounted substantially downstream with respect to the axis of rotation of the applicator roller 11. When the anilox roller 13 is operating, it is positioned against the applicator roller 11. The anilox roller 13 is configured to cover the applicator roller 11 with the pre-coating or post-coating substance.

The upstream coating unit 8 and the downstream coating unit 9 each comprise a supply system 14. The supply system 14 is equipped with a substance tank, a pump, means for circulating the coating substance (not shown), and a device 16 which is applied against the anilox roller 13 in order to supply that roller with coating substance. The supply system 14 makes it possible to supply the anilox roller 13 with the substance.

The device is advantageously of the type having a doctor blade chamber 16. The doctor blade chamber 16 is positioned parallel to the anilox roller 13. The doctor blade chamber 16 can be mounted upstream with respect to the axis of rotation of the anilox roller 13. The doctor blade chamber comprises two doctor blades defining a space for filling the cells of the anilox roller 13 with the coating substance.

To move from an idle and/or cleaning phase (FIG. 2) to the production phase (FIG. 3), the doctor blade chamber 16 pivots (arrow PU in FIG. 2) by virtue of an actuator 17 retracting (arrow U in FIG. 2) and a pivot pin, from a low position to a position applied against the anilox roller 13. In the low position, the doctor blade chamber 16 is situated, for example, parallel to the belt 4. In order to move into the cleaning phase of the doctor blade chamber 16, the doctor blade chamber 16 pivots (arrow PD in FIG. 3) by virtue of the actuator 17 and the pivot pin, from the position applied against the anilox roller 13 to the low position.

According to the invention, the upstream coating unit 8 and the downstream coating unit 9 moreover comprise a recovery system 18. When the recovery system 18 is operating, it is positioned against the applicator roller 11 and more particularly against the homogeneous layer of the porous material 12 of the applicator roller 11. The recovery system 18 can be mounted in proximity to and downstream from the anilox roller 13, downstream being defined with respect to the direction of rotation T of the applicator roller 11. The applicator roller 11 thus becomes clean again after each new revolution by virtue of the recovery system 18.

Given that the printing is performed sheet by sheet, the sheets arrive continuously, conveyed by the belt 4. The sheets are separated from one another by a gap of a few centimeters. Consequently, some substance remains on the applicator roller 11, the latter being continually supplied by the doctor blade chamber 16. The applicator roller 11 rotates continuously T and when it rotates in the region of the gap between two sheets, the substance is not used to coat the surface of the sheets and can be recovered by the recovery system 18.

The sheets which are used to be printed can have a different size, for example a width which is less than the maximum coating length of the applicator roller 11. The recovery system 18 also recovers substance which remains on the applicator roller 11 but outside the shape of the sheet.

The recovery system 18 may be equipped with a doctor blade 19 inserted in a doctor blade carrier 21. The doctor blade carrier 21 with its doctor blade 19 are positioned parallel to the applicator roller 11. In the active position, the edge of the doctor blade 19 is capable of being positioned and pressing against the homogeneous layer of the porous material 12. The edge of the doctor blade 19 is capable of scraping the applicator roller 11 during its rotation T so as to recover excess substance on the applicator roller 11.

The recovery system 18 preferably comprises a suction device 22 for the substance, pre-coating or post-coating. The suction device 22 can be mounted under the doctor blade 19 in order to suck up the excess substance recovered by the doctor blade 19. Indeed the surplus substance accumulates under the doctor blade 19 when the applicator roller 11 rotates. The suction device 22 sucks up this surplus substance.

The suction device 22 can take the form of a perforated pipe applied against the end of the doctor blade carrier 21 and parallel to the doctor blade 19. The suction device 22 is connected to a tube, a pump, and a storage tank for the substance.

The recovery system 18 advantageously comprises a displacement device 23, of the actuator type. The displacement device 23 can shift the recovery system 18, with the doctor blade carrier 21, the doctor blade 19, and the suction device 22, from an active position (see FIGS. 3 and 5) to an inactive position (see FIGS. 2 and 4), and vice versa. In the active position, the doctor blade 19 scrapes the surface of the homogeneous layer of the porous material 12. In the inactive position, the doctor blade 19 is moved away from the applicator roller 11.

The upstream coating unit 8 and the downstream coating unit 9 each preferably comprise a cleaning system 24. The cleaning system 24 can be mounted in proximity to and downstream from the anilox roller 13, downstream being defined with respect to the direction of rotation T of the applicator roller 11. The cleaning system 24 can thus be mounted upstream with respect to the recovery system 18 that is, preceding the recovery system. The cleaning system 24 is capable of being positioned against the applicator system 11, and more particularly against the homogeneous layer of the porous material 12 and capable of cleaning the applicator roller 11 so as to remove any dust.

The cleaning system 24 preferably comprises a roll 26 with a sleeve. The roll 26 is positioned parallel to the applicator roller 11. The sleeve comprises a material which has the property of absorbing the substance. The material of the sleeve of the roll 26 is chosen from the group including cloth-type textiles or the like.

The cleaning system 24 advantageously comprises a sprinkling device 27 mounted above the sleeved roll 26. The sprinkling device 27 is positioned parallel to the roll 26 and to the applicator roller 11. The sprinkling device 27 may take the form of a perforated pipe fed with water or any other water-based cleaning solution. The sprinkling device 27 wets the roll 26. The sprinkling device 27 makes it possible to prevent the textile from becoming abrasive for the flexible rubber 12 of the applicator roller 11. When the roll 26 of the cleaning system 24 is operating, it is positioned against the homogeneous layer of the porous material 12 in order to clean and wet the applicator roller 11.

The cleaning system 24 preferably comprises a displacement device. The displacement device moves the cleaning system 24 with the sleeved roll 26 and sprinkling device 27 from an active position against the applicator roller 11 (see FIGS. 4 and 5) to an inactive position apart from the applicator roller 11 (see FIGS. 2 and 3), and vice versa.

The operator chooses the position of the constituent parts of the upstream coating unit 8 and/or the downstream coating unit 9. In an inactive idle position (FIG. 2), the anilox roller 13 is moved away from the applicator roller 11. The doctor blade chamber 16 is in the low position. The recovery system 18, with the doctor blade carrier 21, the doctor blade 19 and the suction device 22, is moved away from the applicator roller 11. The cleaning system 24, with the sleeved roll 26 and sprinkling device 27, is apart from the applicator roller 11.

In a production position (FIG. 3), the anilox roller 13 is positioned against the applicator roller 11 in order to cover it with the coating substance. The doctor blade chamber 16 is in a position applied against the anilox roller 13 in order to supply it with the coating substance. The recovery system 18, with the doctor blade carrier 21, the doctor blade 19 and the suction device 22, is in the active position, wherein the doctor blade 19 is scraping the surface of the homogeneous layer of the porous material 12. The cleaning system 24, with the sleeved roll 26 and the sprinkling device 27, can remain moved away from the applicator roller 11.

In a position between two production jobs (FIG. 4), the anilox roller 13 is moved away from the applicator roller 11. The doctor blade chamber 16 is in a position applied against the anilox roller 13 ready to supply it with the coating substance. The recovery system 18, with the doctor blade carrier 21, the doctor blade 19 and the suction device 22, is moved away from the applicator roller 11. The cleaning system 24, with the sleeved roll 26 and sprinkling device 27, is in the active position against the applicator roller 11.

In a washing position (FIG. 5), the anilox roller 13 is positioned against the applicator roller 11. The doctor blade chamber 16 is in a position applied against the anilox roller 13. The doctor blade chamber 16 is fed with water. Consequently, the anilox roller 13 applies water to the applicator roller 11 in order to dilute and remove any trace of substance. The recovery system 18, with the doctor blade carrier 21, the doctor blade 19 and the suction device 22, is in the active position, the doctor blade 19 scraping the surface of the homogeneous layer of the porous material 12. The cleaning system 24, with the sleeved roll 26 and sprinkling device 27, is in the active position against the applicator roller 11. The cleaning system 24, with the sleeved roll 26 and sprinkling device 27, can be applied and can thus be started up periodically.

The present invention is not limited to the embodiments described and illustrated. Numerous modifications can be made without in so doing going beyond the scope of the set of claims.

The invention claimed is:

1. A coating unit for applying a coating substance over all or part of a surface of a flat medium, in a machine for printing flat media, comprising:

a flat medium advancing apparatus positioned and configured to advance a flat medium of the flat media past elements of the coating unit, the flat medium advancing apparatus comprising at least one endless belt, the coating unit comprising:

an applicator roller configured to be driven in rotation and to be positioned against all or part of the surface of the flat medium as the medium is advanced in order to apply the coating substance to the flat medium;

an anilox roller configured to be driven in rotation, and to be positioned against the applicator roller, wherein when the anilox roller is supplied with the coating substance and the anilox roller is against the applicator roller, the anilox roller is located and configured to cover the applicator roller in the coating substance;

a supply system positionable and configured to supply the anilox roller with the coating substance, the supply system comprising:

a substance tank, a pump, a coating substance circulating device positioned and configured to circulate the coating substance, and an anilox roller applying device configured to be applied against the anilox roller to supply the anilox roller with the coating substance; and a positionable coating substance recovery system, mounted downstream with respect to the rotation of the applicator roller, and configured to be positioned against the applicator roller, and configured and operable to recover excess coating substance on the applicator roller; and the coating unit further comprising an applicator roller cleaning system mounted downstream with respect to the rotation of the applicator roller, and configured to be positioned against the applicator roller to clean the applicator roller.

2. The unit according to claim 1, wherein the positionable coating substance recovery system further comprises a coating substance suction device operable for suctioning the coating substance located and configured to suck up the recovered excess coating substance.

3. The unit according to claim 1, wherein the positionable coating substance recovery system further comprises a displacement device positioned and configured to move the recovery system from an active position for recovering the excess substance to an inactive position not for recovering excess coating substance, and vice versa.

4. A unit according to claim 1, wherein the applicator roller cleaning system comprises a cleaning roll comprising a covering sleeve comprised of a material having the property of absorbing the coating substance at the applicator roller.

5. A unit according to claim 4, wherein the material is a textile.

6. A unit according to claim 4, wherein the applicator roller cleaning system further comprises a sprinkling system mounted above the applicator roller and configured for sprinkling the applicator roller.

7. A unit according to claim 4, wherein the applicator roller cleaning system comprises a displacement device configured for moving the cleaning system from an active position for cleaning the applicator roller to an inactive position not for the cleaning, and vice versa.

8. A unit according to claim 1, wherein the applicator roller comprises a homogeneous layer positioned to cover the applicator roller and comprising a porous material having elastic and absorbent properties for the coating substance.

9. A unit according to claim 1, wherein the anilox roller applying device of the supply system comprises a doctor blade chamber.

10. A machine for printing flat media comprising the coating unit of claim 1, wherein the machine comprises at least one printing unit positioned and configured to print on the flat media.

11. A machine according to claim 10, wherein the coating unit is arranged upstream from the at least one printing unit in a direction of advancement of the flat media, and the coating unit is configured to apply the coating substance to the surface of the flat media of each print run of the machine, the coating substance preparing the surface of the media with a pre-coating for receiving the image which is to be printed.

12. A machine according to claim 10, wherein the coating unit is arranged downstream from the printing unit in a direction of advancement of the flat media and the coating unit is configured to apply a coating to the printed image so as to cover the printed surface of the media with a post-coating in order to protect the printed image.

13. A machine according to claim 11, wherein the printing unit comprises at least one digital print head for printing on the coating substance on the flat media.

14. A machine according to claim 11, further comprising:

a second coating unit arranged downstream from the at least one printing unit in a direction of advancement of the flat media, and the second coating unit is configured to apply a coating to the printed image so as to cover the printed surface of the media with a post-coating in order to protect the printed image.

* * * * *